United States Patent [19]

McKee

[11] Patent Number: 4,938,373

[45] Date of Patent: Jul. 3, 1990

[54] SERVING DEVICE

[76] Inventor: Dennis McKee, 1833 Oriole St., San Diego, Calif. 92114

[21] Appl. No.: 727,129

[22] Filed: Apr. 25, 1985

[51] Int. Cl.[5] ..... A47G 19/22

[52] U.S. Cl. ..... 220/23.86; 220/69; 220/90.4; 215/100.5

[58] Field of Search ..... 220/23.6, 23.83, 23.86, 220/69, 90.2, 90.4, 90.6; 229/7 R, 15; 215/100.5

[56] References Cited

U.S. PATENT DOCUMENTS

| | | | |
|---|---|---|---|
| D. 211,532 | 6/1968 | Ashton | 220/23.83 |
| 1,665,289 | 4/1928 | Weaver | 229/15 |
| 2,210,283 | 8/1940 | Cowen | 220/23.86 |
| 2,813,509 | 11/1957 | Bruno | 220/69 |
| 2,997,199 | 8/1961 | Reachi | 220/23.86 |
| 3,079,037 | 2/1963 | Schechter | 215/100.5 |
| 3,257,024 | 6/1966 | Semanchik | 220/23.83 |

FOREIGN PATENT DOCUMENTS

| | | | |
|---|---|---|---|
| 770661 | 7/1934 | France | 220/90.2 |

*Primary Examiner*—George E. Lowrance
*Attorney, Agent, or Firm*—Frank D. Gilliam

[57] ABSTRACT

A serving device including a plate and a liquid container. The plate is molded with a central area configured to grasp and support the container. The container bottom can be inserted into the central area on the upper surface of the plate or the upper open surface of the container can be inserted into the central area on the bottom surface of the plate. An aperture is provided through the central area whereby when the serving device is supported by the container a straw can be inserted through the aperture into the liquid for its removal while the liquid container is inserted into the central area on the bottom of the plate.

6 Claims, 1 Drawing Sheet

SERVING DEVICE

BACKGROUND OF THE INVENTION

The present invention relates to a food serving device and, in particular, a combination plate and liquid container the central portion of the plate formed to either receive and secure the bottom of the container on its upper surface or the top of the container or its bottom surface.

On many occasions food is served buffet or cafeteria style. A person picks up the plate at the start of the serving line. The food is placed on the plate as the person moves along the serving line. At the end of the line the person picks up eating utensils and a container of a drink, such as water or a beverage. The person must then juggle the plate, the utensils and the beverage container either while searching out a place to eat or while actually eating from the plate and drinking from the container. Quite often, this means eating and drinking while supporting the plate on the person's lap or with the container grasped between the person's legs.

U.S. Pat. No. 3,955,672 issued to Keene N. Brundage teaches a plate assembly comprised of a body and cup support member integrally formed with the body. The body is provided with a channel which functions to receive the forearm of the user for support of the plate assembly. The cup support member protrudes into the interior of the channel and functions as a grasping means for balancing the plate assembly when it is positioned on the forearm of the user.

This teaching is an advance over the prior art, but still leaves a wide area for improvement in this art. The plate provides a considerable amount of unusable food surface when considered with a given overall diameter because of the divider and the channel provided to receive the forearm of the user; the weight of the overall device is shifted off center when either the drink is consumed or removed from the plate and the plate still contains food or when the food is removed and the cup still contains a beverage; the divider channel has no use when the user does not desire a drink; the cup must be removed from the plate engagement when the plate is positioned on a planar surface; under certain weight distribution situations, the cup could become disengaged from the plate and the plate would then be allowed to tip causing food to be displaced therefrom; other disadvantages will become apparent when consideration is given to the following disclosure of the present invention.

SUMMARY OF THE INVENTION

It is therefore an object of the present invention to provide a food and drink serving device which overcomes the shortcomings and disadvantages of the prior art which is capable of being positioned on a planar surface or being held in one hand supported by grasping the drink container.

These and other objects and advantages are obtained by utilizing a plate assembly which has the normal food bearing surface and a centrally located liquid container engaging means formed integrally therewith. The plate upper surface is integral with a first circular wall angled upward away from the food bearing surface toward the center of the plate. A second circular wall forms an extension of the first wall and is angled downwardly toward the center of the plate. The space formed by the angled relationship of the walls forms substantially an inverted "V" shaped cavity when viewed from the bottom surface of the plate. A flat surface forms a continuation of the second wall. When carrying the plate and container in one hand, the container is inserted from the bottom of the plate into the inverted "V" shaped cavity where it securely engages the cavity walls and wherein the bottom surface of the engaging means forms a lid for the container.

The plate and liquid container are generally formed of a resilient plastic material, plastic foam material or the like and are formed by an injection molding or otherwise.

An aperture is included in the bottom surface of the engaging means to allow a straw to be inserted into the liquid in the drink container, if desired, so that holding of the serving device and drinking from the container can be performed with only the use of one hand. The cavity formed by the inner wall on the top surface of the plate is angled to grip the bottom of the same drink container when after placing food on the plate and filling the container with a liquid and a planar surface, such as, a table or the like is available for placement of the plate.

Thus, the present invention can be used in two convenient modes and the modes can be changed one to the other almost instantaneously by simple manipulation.

Other objects, features and advantages of the invention will be apparent from the following detailed description when read in view of the accompanying drawings which show, by way of example and not limitation, the now preferred embodiment of the invention.

BRIEF DESCRIPTION OF THE DRAWINGS

A more thorough disclosure of the objects and advantages of the present invention is presented in the detailed description which follows and from the accompanying drawings in which.

DETAILED DESCRIPTION OF THE INVENTION

Figure 1:
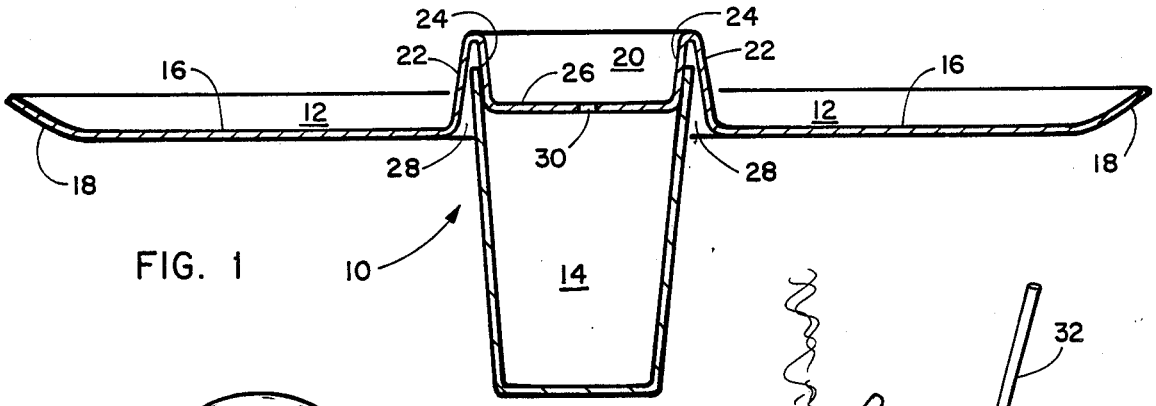
FIG. 1 is a cutaway showing of the details of the serving device of the invention.

The drawings illustrate the preferred embodiment of a serving device according to the present invention. Referring now specifically to FIG. 1, there is shown a cutaway of the serving device 10 of the invention. The serving device 10 comprises a plate member 12 and a liquid container 14.

The plate 12 includes a conventional food placement surface 16 and a food retaining outer lip 18. Centrally located upon and formed integral with the plate is a cavity 20 formed by outer walls 22, inner walls 24 and support surface 26. The walls 22 and 24 are angled away from each other from their upper connection downward. The angle therebetween forms a second cavity 28.

The container 14, shown having a frusto conic crossection not unlike of a conventional drinking cup. The diameter of the bottom portion of the container 14 is configured to press fit into the cavity 20, shown in FIG. 3, so as to be supported and held by the plate 12 while the plate rests on a substantially planar surface. It should also be understood that the plate and liquid containing container could be transported in this manner by the use of only one hand.

Figure 2:
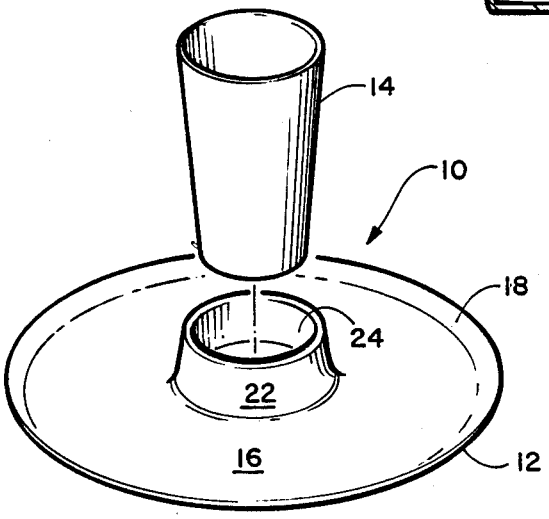
FIG. 2 is a perspective view of the serving device of the invention with the container inserted in the cavity on the upper surface of the plate.

Referring again to FIG. 1, the container 14 is shown positioned for insertion into the cavity 28 between the aforementioned walls 22 and 24. When inserted in this manner, see FIG. 4, the plate containing food and the container containing a liquid can be supported by one hand leaving the other hand free to hold cutlery for eating. When carrying a plate of food and a container of a liquid it is preferable to place the plate and container in the FIG. 4 mode rather than the FIG. 2 mode discussed above. The FIGS. 1, 3 and 4 mode provides better balance to the combination.

Figure 3:
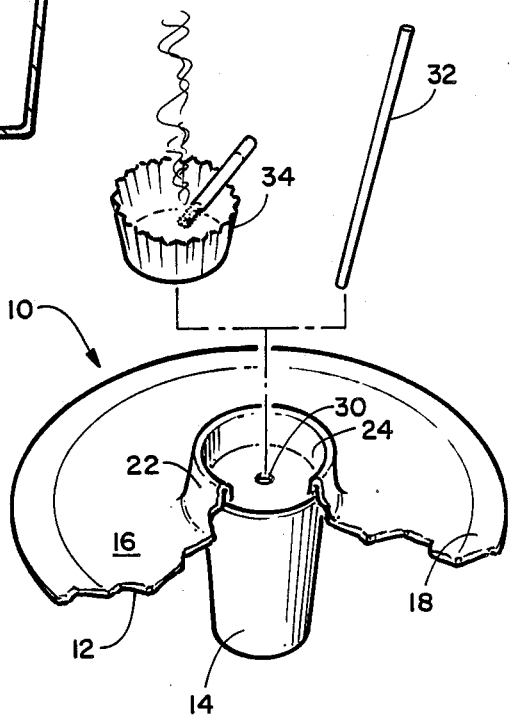
FIG. 3 is an exploded showing of the use of a straw to drink the liquid from the container through the plate aperture and an optional ash receiving means which can be carried by the plate's upper surface cavity.

Referring now to FIG. 3, in addition to the plate and container combination as discussed an aperture 30 is shown through the support surface 28. This aperture allows a conventional straw 32 to be inserted through the support surface and into the liquid contained in the container 14. This feature allows drinking from the container without its removal from the plate cavity. Also shown is an ash tray 34 which can be inserted into the cavity 20 which will not affect the drink or food on the plate.

The plate and/or container may, by way of example and not limitation, be injected molded or otherwise integrally formed from a plastic material or the like which is somewhat resilient to enable the container to grip the plate or vice-versa. Foamed plastic material is also suitable. The plate and container, however, may be constructed of any convenient material which allows gripping engagement between the plate and container in either of the two positioning modes as required.

Figure 4:
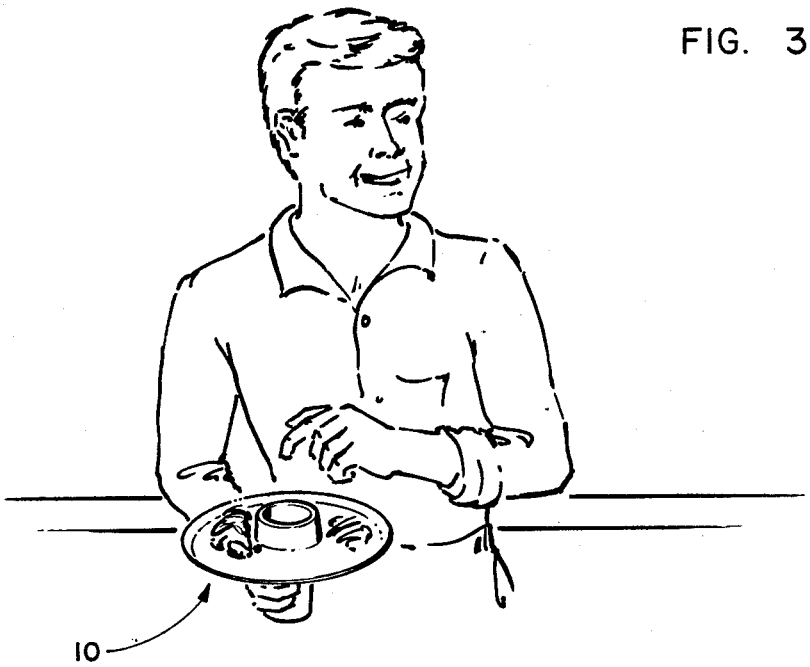
FIG. 4 depicts a person utilizing the invention in a one hand plate/container supported mode.

It should also be obvious that the plate acts as a lid for the container in the FIGS. 1, 3 and 4 showings. When being carried or transported in this mode it may be desirable to have a first closed aperture 30. This is accomplished by providing a frangible spot on the lid through which the straw end can be inserted to open the aperture. This feature is well known in the container lid art and does not form a part of this invention.

While only one embodiment of the invention has been shown and described in detail, there will now be obvious to those skilled in the art many modifications and variations which satisfy many or all of the objects of the invention but which do not depart from the spirit thereof as defined by the appended claims.

What is claimed is:

1. A serving device comprising:

a liquid container formed of resilient material having a top and bottom;

a plate member formed of resilient material, said plate member comprises an upper substantially planar food placement surface and a substantially planar bottom surface and a central area substantially smaller than said food placement surface configured to removably secure thereto the bottom of said container to said central area on its upper food placement surface and the top of said container on its bottom surface by a press fit gripping relationship while containing food on said upper food placement surface;

said central area is elevated from the upper surface of said plate member and comprises a first wall means formed as a continuation of said plate and a second wall means formed as a continuation of said first wall means and angularly spaced therefrom and a support surface formed as a continuation of said second wall means and is substantially parallel to the upper and lower surface of said plate, said second wall means and support surface configured to receive the bottom of said container in said press fit gripping relationship and the space between said first and second wall means configured to receive and secure thereto the top of said container in said press fit relationship.

2. The invention as defined in claim 1 wherein said plate including said central area is formed as an integral structure.

3. The invention as defined in claim 1 wherein said first and second wall means comprise substantially circular first and second walls, said first wall is angled upwardly toward the center of said plate and said second wall is angled downwardly toward the center of said plate thereby providing a substantially inverted "V" shaped space between said walls on the lower surface of said plate member.

4. The invention as defined in claimed 3 further comprising an aperture through said central area.

5. The invention as defined in claim 1 wherein said container and plate member are formed of plastic foam material.

6. A serving device comprising:

a liquid container formed of resilient material having a top and bottom, a plate member formed of resilient material, said plate member comprises an upper substantially planar food placement surface and a substantially planar bottom surface and a central area substantially smaller than said food placement surface configured to removably secure thereto the bottom of said container to said central area on its upper food placement surface and the top of said container on its bottom surface by a press fit gripping relationship while containing food on said upper food placement surface; and an ash tray receivable in a secured press fit relationship with said central area.

* * * * *